United States Patent [19]

Runo et al.

[11] Patent Number: 4,779,793

[45] Date of Patent: Oct. 25, 1988

[54] SEAL CLOSURE

[76] Inventors: William R. Runo, 23 John St., Fairfield, N.J. 07006; Thomas Kristo-Nagy, 86 Ridgewood Rd., Clifton, N.J. 07012

[21] Appl. No.: 117,493

[22] Filed: Nov. 6, 1987

[51] Int. Cl.[4] ..... B65D 39/00

[52] U.S. Cl. ..... 229/125.12; 220/260; 220/345; 229/125.14; 229/125.15

[58] Field of Search ..... 229/125.12, 125.14, 229/125.15, 125.37, 160.2; 383/59, 62, 52; 220/260, 345, 359

[56] References Cited

U.S. PATENT DOCUMENTS

| | | | |
|---|---|---|---|
| 2,564,252 | 8/1951 | Dickson, Jr. | 229/125.14 |
| 2,628,761 | 2/1953 | Yancey | 229/125.12 |
| 2,847,151 | 8/1958 | Meyer-Jagenberg | 229/125.14 |
| 3,040,967 | 6/1962 | Klein | 383/52 |
| 4,557,414 | 12/1985 | Ford et al. | 220/359 |
| 4,577,777 | 3/1986 | Brochman | 220/359 |
| 4,632,299 | 12/1986 | Holmberg | 229/125.15 |

FOREIGN PATENT DOCUMENTS

| | | | |
|---|---|---|---|
| 27162 | of 1909 | United Kingdom | 229/125.12 |
| 356800 | 9/1931 | United Kingdom | 229/125.12 |

*Primary Examiner*—Stephen Marcus
*Assistant Examiner*—Gary E. Elkins
*Attorney, Agent, or Firm*—Barnes & Thornburg

[57] ABSTRACT

A sealing device arrangement is provided for a container to be filled through an opening. The base strip attaches the sealing device to the container. Sealing strip elements are mounted to the base strip and are used for sealing the container opening. Protecting strip elements are provided for activating and protecting the sealing elements prior to and during activation of the sealing strip elements from a filling position to a sealing position. Resistance strip elements are provided which create resistance between the resistance strip and the base strip when the sealing strip elements are activated, thereby reducing exposure of the sealing surface to atmosphere during activation.

29 Claims, 2 Drawing Sheets

SEAL CLOSURE

BACKGROUND AND SUMMARY OF THE INVENTION

A sealing device is provided which provides a strong seal closure of inlet or fill opening on packages and containers of flexible or rigid construction of all sizes and shapes.

When sealing containers holding granular, powdered, or liquid materials, it is often required that a material inlet opening be positively sealed to ensure that no product leaks out, and that no foreign body penetrates into the sealed opening to contaminate the product. When the container is filled, the sealing must be accomplished quickly, easily, and positively, and with minimum complexity in terms of operation and equipment.

Further, during the filling of containers, it is not uncommon for the seal area adjacent the opening to become contaminated with the product entering the container. This contamination has a detrimental effect on the closure integrity, thus preventing adequate sealed closure in those instances where the method of closure requires a non-contaminated seal area.

Often in sealing, adhesives must be applied during or just prior to closure, which requires an adhesive reservoir, piping, a dispenser and a control mechanism. Further, if the adhesives are applied in the area of container filling, the integrity of the adhesives can be damaged by surrounding granules, powder or other particles. Generaly, in prior types of sealing arrangements using adhesives or tape placed over a fill hole, dust, powder or other material which may come from the filling contents of the container or from the environment, interfere with the integrity of the seal. Thus, powder or granules can be adhered to a tape strip or the adhesive material rendering the seal weaker. Further, the area where the tape or adhesive is to be applied is often contaminated with powder or granules which would also interfere with the integrity of the seal even if the sealing elements were introduced after the filling procedure.

Further, often a heat energy source is required in the sealing of a container just prior to closure, in addition to a transfer mechanism, to reactivate a preapplied hot melt adhesive, or to apply a hot melt adhesive in the seal area.

Also, often when a seal is placed on a container, in the manufacturing stage, separate closure sources or equipment for positioning, activation, or operation are required to apply the seal. With the existing sealing methods, it is often required that an empty space below the closure and above the material level of the flexible container exist, for the preforming of the filled, open flexible container, for the proper operation of the sealing devices. Other existing closure limitations may require a space above the material level in the bag to be free to accommodate necessary machinery for filling. Also, often the shape of the opening is restricted due to the type of seal closures available.

An object of the invention is to provide a seal which is protected from particle or dust contamination during container filling, and at all times during the sealing operation by reducing exposure of the seal to the environment during closure.

Another object of the invention is to provide a sealing device which does not require the application of adhesives during or just prior to seal closure. A further object of the invention is to provide a seal which does not require a heat energy source at the time of sealing.

A still further object of the invention is to provide a closure which provides a positive hermetic seal.

Yet another object of the invention is to provide a seal which requires no empty space below the seal and above the material level in the flexible container.

Still another object of the inveniion is to provide a seal which allows the opening of a container to have any configuration and to have an increased opening size without altering the optimum container dimensions.

Another object of the invention is to provide a seal which can be equally effective in a dry or wet environment and in normal atmosphere or in vacuum conditions.

These objects are achieved by providing a sealing device for a container to be filled including attachment or base elements for attaching sealing elements of the sealing device to the container. Protecting elements are provided for activating the sealing elements and protecting them from the environment prior to and during transfer of the sealing elements from a filling position of the sealing elements to a sealing position of the sealing elements. Resistance elements are provided above the protecting elements and sealing elements for creating resistance when the sealing strip is activated and transferred thereby reducing exposure of the sealing surface to atmosphere during closure.

In all the embodiments, any portion of the attachment elements, sealing elements, protecting elements or resistance elements which extend across the full opening of the container in the filling position to which the sealing device is to be mounted, includes an fill hole opening. In one set of embodiments, all the elements except the sealing element includes a fill hole opening since the seal element is attached at one side of the fill hole opening and bends back 180° in its fill position. The protecting element and the resistance element extend from the bend back portion of the sealing element across the fill hole openings. Where additional adhesive is Provided on the upper face of the attachment element, additional layers of the protecting elements are provided with appropriate fill hole openings. The additional Protecting elements are joined to the protecting element for the sealing element such that both adhesive areas can be exposed during a common activation. In such case the protecting element has a generally S-shaped full pattern. In one embodiment, the sealing element has a S-shaped connecting the first and second end portions of the sealing elements wherein the first end portion extends across and includes a fill hole opening. The joining S-shape of the sealing element does not extend across the fill hole openings.

Other objects, advantages and novel features of the present invention will become apparent from the following detailed description of the invention when considered in conjunction with the accompanying drawings.

DETAILED DESCRIPTION OF THE DRAWINGS

The present invention is designed to provide a better seal closure of containers which is achieved by reducing the exposure of sealing surfaces to atmosphere during activation from a filling position of the seal to a sealed position of the seal. To provide the advantageous results of the present invention, layers of strips are Provided on a base strip to be attached to the container to be filled. A sealing strip is provided directly above the base strip and is attached at one end to the base strip. The sealing strip is disposed in such a way that adhesive surfaces on the sealing strip are not exposed to the atmosphere prior to activation to seal the container, and are protected from the atmosphere by a releasable protecting strip. The protecting strip also serves as the activating element which pulls the sealing strip over a container opening for sealing.

A cover or resistance strip is placed above the base strip, the sealing strip and the protecting strip, and is attached to the base strip. The resistance strip causes a reduction of the exposure of the sealing surface to atmosphere during activation by limiting the height of the bent portion of the sealing strip and biasing it towards the base strip. Thus, the protecting strip pulling the sealing strip is prevented from uncovering the adhesive surface of the sealing strip until the revealed adhesive surface is immediately adhered to the base strip. Further, by limiting the distance which the protecting strip can be raised above the sealing strip during activation, the area of the adhesive surface of the sealing strip revealed by the protecting strip during activation is kept to a minimum, and therefore there is minimal exposure to the atmosphere. Further, the resistance strip provides a resistance which also serves to create a pushing force between the sealing strip and the base strip during activation which provides a stronger seal between the adhesive surfaces during sealing.

Figure 1:
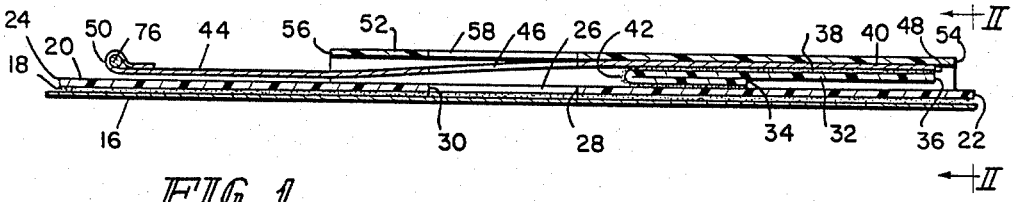
FIG. 1 is a cross-sectional side view of a seal closure according to one embodiment of the invention taken along lines I—I of FIG. 2.
Figure 2:
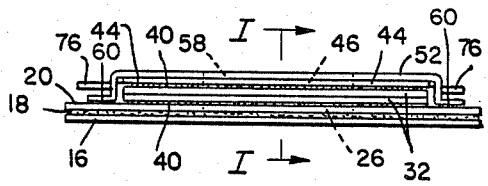
FIG. 2 is an end view of the embodiment shown in FIG. 1.

The first embodiment of the invention is shown in cross-section in FIGS. 1 and 2. The sealing device includes an attachment or base strip 20 as a bottom layer having an adhesive layer 18 covered by a release strip 16 for attaching the sealing device to a container having an opening to be sealed. The base strip includes a first end 22 and a second end 24. The base strip includes a fill hole opening 26 which can be of any shape or size depending on the fill hole of the container to be sealed. The fill hole 26 includes a first end perimeter edge 28 closest to the first end 22 of the base strip, and includes a second end perimeter edge 30 closest to the second end 24 of the base strip.

Attached to the top of the base strip 20 is a sealing strip 32 which includes a first end 34 and a second end 36. The first end 34 of the sealing strip 32 is mounted between the first end perimeter edge 28 of the fill hole opening 26 and the first end 22 of the base strip 20. The sealing strip is folded back 180° at 42 such that no part of the sealing strip 32 overlaps any portion of the base strip fill hole opening 26. The sealing strip 32 includes a sealing surface side 38 which includes a contact adhesive surface or adhesive material 40 capable of adhering to the top surface of the base strip 20.

The contact adhesive surface 40 can be included on a portion of the sealing surface 38 or included on the entire sealing surface 38. In certain preferred embodiments, the area of the sealing surface 38 which coincides with the base strip fill hole opening 26 in the sealed position does not include adhesive material 40.

To protect the adhesive surface 40 of the sealing strip 36 from contamination, a releasable protecting strip 44 is aligned over the portion of the sealing strip 32 not already secured to the base strip 20. The protecting strip 44 includes a fill hole opening 46 having approximately the same diameter as fill hole opening 26 of the base strip 20, and is aligned coaxially over the fill hole opening 26. The protecting strip 44 includes a first end 48 connecting to the second end 36 of the sealing strip and a second end 50 extending past the base strip fill hole opening 26. The protecting strip has a length starting from the second end 36 of the folded sealing strip 32, terminating at a point along the base strip 20, beyond the fill hole opening 26, and beyond the point where the second end 36 of the sealing strip 32 would extend to when unfolded to lie flat on the base strip with the sealing surface 38 facing the base strip.

The protecting strip has a width at least as wide as the sealing strip 32 and completely covers the sealing surface 38 of the sealing strip 32 facing away from the base strip 20. The protecting strip 44 can include a pulling bar or rod 76 on the second end of the protecting strip. This pulling bar 76 can be associated with an automatic pulling mechanism or can be manually pulled. The pulling rod 76 can be a rigid rod of plastic or other suitable material fastened to the second end of the protecting strip 44, extending beyond the strip width, to permit mechanical attachment for closure. Other methods of engaging the protecting strip may also be employed, including providing holes adjacent the second end 50.

Adhesive surface 40 of the sealing strip sealing surface 38 folded back and facing the protecting strip 44 contacts the protecting strip 44. The protecting strip has a glossy surface such that its contact with the adhesive surface 38, 40 of the folded sealing strip has a low peel and a high shear strength.

A resistance strip 52 is placed over all of the other strips and secured to the base strip 20. The resistance strip 52 has a first end 54 closest to the first end 22 of the base strip 20 and has a second end 56 closest to the second end 24 of the base strip 20. The resistance strip has a length that can extend beyond the first end 48 of the protecting strip 44 and the second end 36 of the folded sealing strip 32, and extends toward the second end 24 of the base strip 20 past the fill hole openings 26 of the base strip 20 and 46 of and the protecting strip 44. The resistance strip 52 also extends beyond the point where the second end 36 of the sealing strip 32 would extend to when unfolded to lie flat on the base strip 20 with the sealing surface 38 facing the base strip 20. The resistance strip second end 56 does not extend as far out toward the second end 24 of the base strip as the second end 50 of the protecting strip 44 extends. Thus the protecting strip second end 50 extends out past the resistance strip 52 to provide access thereto for activation.

The width of the resistance strip 52 is wider than the protecting strip 44 and can be as wide as the base strip 20.

The resistance strip 52 includes a fill hole opening 58 having approximately the same diameter as the fill hole opening 26 of the base strip 20. The fill hole opening 58 is aligned coaxially with the fill hole opening 26 of the base strip 20 and the fill hole opening 46 of the protecting strip 44 when the seal closure is in the fill position illustrated in FIGS. 1 and 2.

The resistace strip 52 is firmly secured, either by adhesive, or thermally, or by any other suitable means, to the base strip 20 along the two edges 62, 64 of the resistance strip 52 perpendicular to the first end 54 and the second end 56. In certain preferred embodiments, the first end 54 of the resistance strip 52 can also be secured to the base strip 20.

Figure 3:
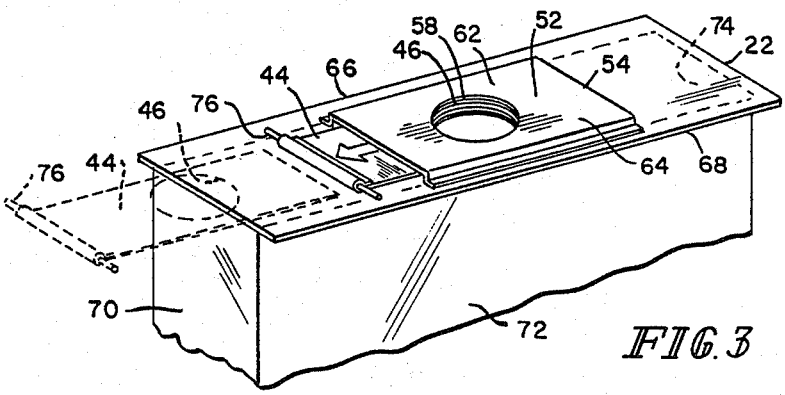
FIG. 3 is a perspective view of the seal closure of FIG. 1 attached to a package.

As shown in FIG. 2, the resistance strip 52 is attached to the top of the base strip 20 by suitable connecting elements such as adhesives, thermal fusion, or any other known sealing elements 60. As shown in FIG. 3, the resistance strip 52 is centered over the base strip 20 such that longitudinal edges 62, 64 of the resistance strip perpendicular to the first and second ends of the resistance strip, are inside the perimeter of the base strip longitudinal edges 66 and 68.

The first end 54 of the resistance strip could feasibly extend to the first end 22 of the base strip. However, as shown in FIG. 3, the first end 54 can be spaced inwardly from the first end 22 of the base strip. In either case, this first end 54 of the resistance strip can be secured to the base strip 20 or left free.

FIG. 3 also illustrates the seal closure attached to a container. The container includes side walls 70, front and back walls 72 and top wall 74. The base strip 20 is secured to the top wall 74 by adhesive 18 after removal of release strip 16. The top wall 74 includes an opening coaxial to the openings 26 and 58 of the seal closure and may be larger than or equal to openings 26 and 58. In the specific embodiment shown, the width of the base strip 20 is greater than that of the top wall 74 of the bag so as to extend there beyond. This extension on each side allows the holding equipment to grab the flexible container at these extensions during filling and sealing. The base strip 20 may be made of flexible material such that the extension may be folded down after sealing. If this is not applicable to the particular container or filling machine, the base strip 20 may have dimensions the same as or less than the top wall 74 of the container or package.

Figure 4:
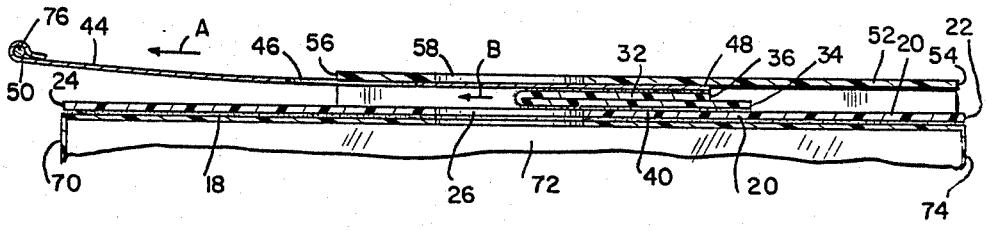
FIG. 4 is a cross-sectional side view of the sealing device of the embodiment shown in FIGS. 1 and 2 at a stage of activation.

In operation as shown in FIG. 4, by pulling the second end 50 of the protecting strip 44, as shown by arrow A, the protecting strip causes the second end 36 of the folded sealing strip 32 to move forward as shown by arrow B following the protecting strip 44 toward the second end of the base strip 20 due to the high shear strength contact between the protecting strip and the sealing strip. As the protecting strip continues to move away from the first end 24 of the base strip 22, the low peel strength contact between the sealing strip and the protecting strip permits the fold of the second strip to move forward, exposing the Clean sealing surface side 38 and adhesive surface 40 of the sealing strip to the clean top surface of the base strip 20.

The combination of the fold curve in the sealing strip 32, and the resistance of the secured resistance strip 52 to the base strip 20, forces the adhesive surface 40 of the sealing strip 32 against the clean top surface of the base strip 20. Further, the resistance strip 52 reduces the area of the sealing surface exposed to the environment during activation by only allowing a limited folding line to be exposed by the protecting strip. This is accomplished by limiting the distance the protecting strip is allowed to move up off the sealing strip. Therefore, by reducing the distance between the base strip and the resistance strip, less of the sealing surface will be exposed during activation. This distance must, however, allow movement of the protecting strip and sealing strip during activation.

When the sealing strip 32 is completely separated from the protecting strip 44, such that the sealing strip sealing surface 40 lies flat along the top surface of the base strip 20, the fill hole opening 26 is covered and sealed by an adhesive contact between the base strip and the sealing strip.

The base strip 20, sealing strip 32, resistance strip 52, protecting strip 44 and release strip 16 may be paper, plastic film, metallic films, other films or combinations thereof. The protecting strip 44 and release strip 16 should have a low peel and high shear strength surface bond with adhesive surface so as to release easily from the adhesive material between them and base strips 20 and sealing strip 32, respectively. The base strip 20 can be flexible material, but should not be stretchable material since stretching of the base during activation of the seal closure between filling and sealing positions would adversely effect the seal. The sealing strip 32 should be springy material, not easily creased. Otherwise, the folded edge at 42 will not travel during activation and a crease would adversely effect the seal.

Figure 5:
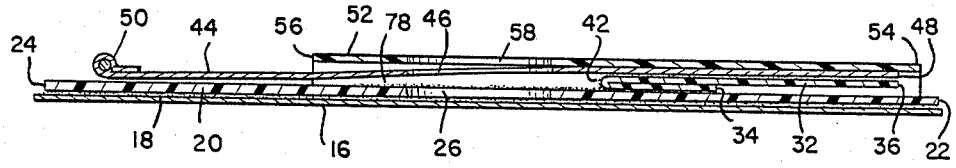
FIG. 5 is a cross-sectional side view of a seal closure according to another embodiment of the invention.

According to another advantageous embodiment, as shown in FIG. 5, the top surface of the base strip 20 can be coated with an adhesive surface 78 that is very weak in shear and very strong in peel. When the protecting strip 4 is removed by pulling, there will be little resistance to its motion against the base strip adhesive surface 78, however, the sealing strip adhesive surface 40 is bonded to the base strip adhesive surface 78.

Figure 6:
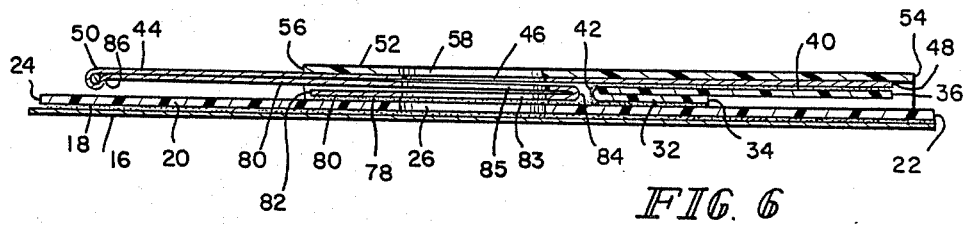
FIG. 6 is a cross-sectional side view of a seal closure according to another embodiment of the invention.
Figure 7:
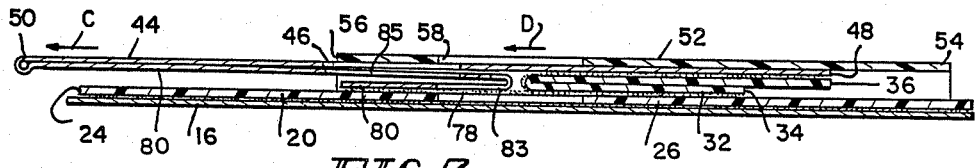
FIG. 7 is a cross-sectional side view of the sealing closure of the embodiment shown in FIG. 6 at a stage of activation.

Another advantageous embodiment is shown in FIGS. 6 and 7. The embodiment shown in FIG. 6 is similar to the embodiment shown in FIG. 5, with the addition of an additional proteotinq strip 80 for the adhesive layer 78 exposed in FIG. 5. Similar to the first protecting strip 44, the second protecting strip 80 has a high gloss surface contacting the adhesive surface 78 of the base strip 20 and the adhesive surface 78 has the same adhesive material as adhesive surface 40. A first end 82 of the second protecting strip 80 is placed at the outer perimeter of the adhesive surface 78 of the base strip 20 on the side of the fill opening 26 closest to the second end 24 of the base strip 20 facing the second end 24.

The second protecting strip 80 lies flat on the base strip adhesive surface 78 and extends across the fill hole opening 26. Prior to reaching the fold line 42 of the sealing strip 32, the second protecting strip 80 is folded back 180° at a fold line 84 back across the fill hole opening 26 on a plane above the section of the second Protecting strip 80 which contacts the adhesive surface 78 of the base strip 20. The second protecting strip 80 continues in this plane and has a second end 86 adjacent the second end 50 of the first protecting strip 44.

The folded second protecting strip 80 includes two cut-out portions 83, 85 which coincide with the fill hole opening 26 of the base strip 20 in the areas where the folded second protecting strip 80 overlies the fill hole opening 26 of the base strip 20. In certain preferred embodiments, these cut-out portions 83, 85 have the same dimensions as the fill hole opening 26 and are ooaxial with the fill hole opening 26.

The first protecting strip's second end 50 and the second protecting strip second end 86 can be attached to each other in any suitable way thereby forming an S-shaped doubled fold. In certain preferred embodiments, these two ends can form a loop which holds the pulling rod 76. Also in certain preferred embodiments, the first and second protecting strips 44 and 80 can be one continuous strip and the attachment of the two as shown in FIG. 6 shown at 86 can be another 180° fold line.

In operation as shown in FIG. 7, the first and second protecting strips 44 and 80 are pulled together toward the second end 24 of the base strip 20 as shown by arrow C to effect the closure and seal. As the protecting strips are pulled, the second protecting strip 80 exposes the adhesive surface 78 of the base strip 20 as the first protecting strip 44 positions the sealing strip sealing adhesive surface 38 for contact with the adhesive surface 78 on base strip 20 in a smooth, continuous motion (shown by arrow D).

Figure 8:
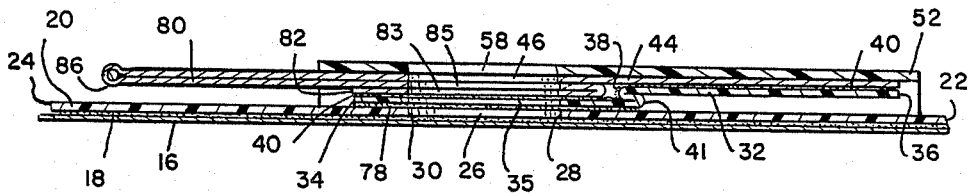
FIG. 8 is a cross-sectional schematic of a seal closure according to another embodiment of the invention.

Still another advantageous embodiment is shown in FIG. 8. This embodiment is similar to that shown in FIG. 6 wherein two protective strips are used. The improvement in FIG. 8 is that the sealing strip 32 has its first end 34 positioned between the edge 30 of fill hole 26 and the second edge 24 of the base strip 20. The sealing strip 32 extends towards the second edge 22 of the base strip 20 past the second edge 28 of the fill hole 26. After it passes the filling hole 26, it is reversed 180° at fold line 41 extending back towards the fill hole 26. Before reaching the fill hole 26 the sealing strip 32 is again reversed 180° at the fold line 42 and extends back towards the first end 22 of the base strip 20. Thus the sealing strip 32 has an S-shaped double fold connecting the two ends.

The sealing strip 32 between its first end 34 and the first 180° fold line 41 is secured to the base strip 20 by the adhesive 78. The adhesive 40 which extends across the top surface of the sealing strip 32 causes the portion of the sealing strip 32 between the 180° fold lines 41 and 42 to be stuck to itself. The sealing strip 32 between the first end 34 and the fold line 41 includes a fill hole 35 which is coaxial with and generally the same size as the fill hole 26 in the base strip 20.

As in the FIG. 6 embodiment, the second protecting strip 80 begins from a first end 82, extends over the fill hole reversing at 84 and terminates at a second end 86. The first strip 80 includes a fill hole 83 and 85. Different from the embodiment of FIG. 6, the first end 82 is secured on top of the sealing strip 32 instead of on the base strip 20. The first protecting strip 44 overlies the remaining portion of the sealing strip 32 and is joined to the second sealing strip 80 to form an S-shaped double fold. A filling hole 46 is provided in the first protecting strip 44.

For ease of manufacture, the first protecting strip 44 and the second protecting strip 80 are formed from one continuous piece of material with the connection of the two shown at 86 as a 180° fold line. The resistance strip 52 is positioned above the first protecting strip 44 and includes a fillinq hole 58.

The advantage of this embodiment over the previous three embodiments is that the seal strip 32, protecting strip 80, and base strip 20 or more easily aligned in direction of activation during manufacture. In the previous embodiments, the positioning of the first end 34 of the sealing strip 32 on the base strip adjacent to edge 28 of the fill hole 26 in the base plate becomes more critical. Also, by providing a larger area for the first end 34 of the sealing strip 32 to be attached to the base plate 20 in the fill position, greater stability during activation from the filling to the sealed position of the sealing strip results.

In all of these embodiments, the arrangement of the protecting strip and the resistance strip protects the area of the base strip to be sealed from contamination by dust, powder, granules, or any other materials which could adversely affect the integrity of the seal. Further, the protecting strip prevents the areas of the base strip and the sealing strip which have adhesive surfaces thereon from any contact with powders or granules of the environment or from the materials which are placed into the container during filling.

Further, in all of these embodiments, the sealing device is manufactured to come as a preformed unit which requires no heat energy source or transfer mechanism to reactivate a preapplied hot melt adhesive, and requires no application of adhesives during or just prior to closure. This eliminates the need for an adhesive reservoir, piping, dispenser and control mechanism at the site of sealing, and eliminates problems associated with exposed adhesives including contamination. Therefore, the closure operation is very simple and extremely fast, requires no tools or mechanical devices and protects the sealing area prior to and during filling such that foreign materials do not interfere with the integrity of the seal.

Further, as the sealing device is clamped to the top of the container and becomes an integral part of the container, the sealing device requires no empty space below the top of the container where the sealing device is attached and above the material level in the container for its operation. The material level can be right up to the top inside surface of the container, and therefore, the container size need only be as large as the actual volume of material contents, thereby reducing wasted container space and providing a more compact container. Further, as the container size is equal to the material volume therein, the container will maintain its shape after filling and during transportation and storage which can be very important, for example when the containers are block bags which are stacked.

This sealing device can be used equally effectively in a dry or a wet environment, and in normal atmospheric or vacuum conditions.

Further, there are no limitations on the fill opening size of the container using this sealing device. Therefore, the shape of the opening can have any configuration and the opening size can be significantly large to increase the rate of filling.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Sealing device arrangement for a container to be filled through an opening, comprising:

base strip means for attaching said sealing device to the container;

sealing strip means including a sealing surface and mounted to said base strip means for sealing the container opening, said sealing strip means having a filling position exposing said container opening and having a sealing position for sealing said container opening;

protecting strip means for activating and protecting said sealing strip means prior to and during activation of said sealing means from said filling position to said sealing position; and resistance strip means disposed above said sealing strip means and said protecting means for creating resistance between said resistance strip means and said base strip means when said sealing strip means is activated thereby reducing exposure of said sealing surface to atmosphere during activation.

2. Sealing device as in claim 1, wherein said attaching means includes mounting means for mounting the attaching means to the container.

3. Sealing device as in claim 1, wherein said sealing strip means includes a sealing surface side including a first adhesive surface section on at least a portion thereof, said protecting strip means protecting said first adhesive surface section from the environment.

4. Sealing device as in claim 3, wherein said protecting strip means is disposed over said base strip means, said base strip means and said protecting strip means each including adjacent first and second end sections, said base strip means further including a fill hole means disposed between said bore strip means first and second end sections for exposing the opening in the container, said protecting strip means in said filling position further including a fill hole opening coaxial with said base strip means fill hole means.

5. Sealing device as in claim 4, wherein said sealing strip means is geometrically centered over the fill hole means in the base strip means in the sealing position.

6. Sealing device as in claim 4, wherein said sealing strip means includes a non-adhesive area on said sealing surface side of said sealing strip means coinciding with said fill hole means of said base strip means in said sealing position.

7. Sealing device as in claim 4, wherein said protecting strip means includes a pulling end closer to said second end of said base strip means for pulling said protecting strip means away from said first end section of said base strip means such that said sealing strip means is pulled from said filling position over said fill hole means of said base strip means toward said sealing position for sealing the container by unfolding said folded sealing strip means.

8. Sealing device as in claim 7, wherein said pulling end of said protecting strip means includes an engaging means attached thereto for engaging a mechanical device which pulls said protecting strip means for sealing the container.

9. Sealing device as in claim 7, wherein said resistance strip means forces said sealing strip means adhesive surface against said base strip means during pulling of said protecting strip means.

10. Sealing device as in claim 3, wherein said protecting strip means has a width coinciding with a width of said sealing strip means.

11. Sealing device as in claim 10, wherein said sealing strip means has a width less than a width of said base strip means.

12. Sealing device as in claim 3, wherein said protecting strip means includes a first contacting side portion contacting said first adhesive surface section of said sealing strip means, said contacting side portion including a glossy surface such that there exists a low peel and high shear contact between said protecting strip means and said sealing strip means.

13. Sealing device as in claim 4, wherein said sealing strip means in said sealing position includes a first end adjacent said first end sections of said base strip means and said protecting strip means and include a second end adjacent said second end sections of said base strip means and said Protecting strip means, and said sealing strip means in said filling position being completely disposed between said fill hole means and said first end sections of said base strip means and said protecting strip means.

14. Sealing device as in claim 13, wherein a first end portion of said sealing surface side of said sealing strip means faces said base strip means and is attached to said base strip means by an adhesive, said sealing strip means being folded back over said sealing strip means first end portion away from said fill hole means at a fold line between said fill hole means and said first end section of said base strip means such that said sealing surface side from said fold line to said second end of said sealing strip means forms a second sealing surface portion facing away from said base strip means, said second sealing surface portion including said first adhesive surface secion.

15. Sealing device as in claim 14, wherein said protecting strip means includes a first protecting strip covering the second sealing surface portion of said sealing strip means, said first protecting strip includes a pulling end closer to said second end of said base strip means for pulling said first protecting strip away from said first end section of said base strip means such that said sealing strip means is pulled from said filling position over said fill hole means of said base strip means toward said sealing position for sealing the container by unfolding said folded sealing strip means.

16. Sealing device as in claim 4, wherein said resistance strip means includes a resistance strip attached to said base strip means along edges perpendicular to said first and second end sections of said base strip means, said resistance strip including a first end extending past said second end of said sealing strip means in said sealing strip filling position and including a second end extending past said fill hole means, said resistance strip including a fill hole opening coaxial with said fill hole means of said base strip.

17. Sealing device as in claim 16, wherein said resistance strip second end extends past said second end of said sealing strip means in said sealed position of said sealing strip means.

18. Sealing device as in claim 16, wherein said resistance strip first end is sealed to said first end section of said base strip means.

19. Sealing device as in claim 15, wherein said base strip means includes an adhesive surface facing said protecting strip means being weak in shear and strong in peel.

20. Sealing device as in claim 19, wherein said base strip means adhesive surface extends in at least a portion of said base strip surface from said first end of said sealing strip means through the region of said fill hole means and into an area between said second end section of said base strip and said fill hole means.

21. Sealing device as in claim 20, wherein said protecting strip means further includes a second strip having one end attached to a portion of said adhesive surface of said base strip means adjacent to said said second end portion of said base strip means and extending over said fill hole means, said second protecting strip being folded 180° at a portion of said base strip means disposed near said fold line of said sealing strip means and extending back across said fill hole means toward said second end section of said base strip means, said second protecting strip having a second end which terminates adjacent with said pulling end of said first protecting strip, said second protecting strip being operable by pulling with said pulling end of said first protecting strip.

22. Sealing device as in claim 21, wherein said second end of said second protecting strip is attached to said pulling end of said first protecting strip.

23. Sealing device as in claim 21, wherein said second protecting strip and said first protecting strip are a continuous strip having a 180° fold at the point where said second ends of said first and second protecting strips meet.

24. Sealing device as in claim 4, wherein said sealing strip means include a first end section mounted to said base strip means between fill hole means and said second end section of said base strip means and extending past said fill hole means, and includes a fill hole opening coaxial with said fill hole means.

25. Sealing device as in claim 24, wherein in said sealing position, said sealing strip means folds back over said first end section of said sealing strip means; and in said filling position, said sealing strip includes an S-shaped double fold over a portion of said first end section of said sealing strip between said fill hole opening and said first end section of said base strip means and includes a second end section extending from said fold over said first end section of said base strip.

26. Sealing device as in claim 25, wherein said sealing surface of said sealing means extends along said first and second end section of said sealing means; in said filling position, said second end section of protecting strip means extends over said sealing means first end section; said protecting strip means has an S-shaped double fold extending over said fill hole means twice and said first end section of said protecting strip means extend from said fold over said second end section of said sealing strip means; and said S-shaped double fold of said protecting strip means includes a pair of fill hole openings coaxial with said fill hole means.

27. Sealing device for a container to be filled whtough an opening comprising:

sealing strip means for sealing the container opening, said sealing strip means having a first end section with a first fill hole opening therein, in a filling position said sealing strip means having an S-shaped double fold positioned over a portion of said first end section exterior said first fill hole opening and a second end section extending from said fold away from said first fill hope opening, in a sealing position said sealing strip means having a single fold positioning said second end section over said first end portion to cover and seal first fill hole opening and said container opening;

an adhesive on a sealing surface of said second end section of said sealing strip means;

protecting strip means including a first end section for covering said adhesive on said second end section of said sealing strip means and extending across said first end section of said sealing strip means in a filling position, and including a second fill hole opening coaxial with said first fill hole opening in said sealing strip means in said filling position; and mounting means on a mounting surface of said first end section of said sealing strip means for mounting said sealing strip means to a container with said first and second fill hole opening exposing said container opening.

28. Sealing device as in claim 27, wherein said first end section of said sealing means includes adhesive on a sealing surface, and said protecting means includes a second end section covering said sealing surface on said first end section of said sealing means and including a third fill hole opening coaxial with said first and second fill hole openings.

29. Sealing device as in claim 28, wherein said protection means includes an S-shaped double fold extending over said first fill hole opening and including portions of said first and second end sections of said protection means which include said second and third fill hole openings and includes a fourth fill hole opening in the intermediate leg of the S-shaped double fold coaxial with said other fill hole openings in said filling position.

* * * * *